US006596207B1

(12) United States Patent
Gunn

(10) Patent No.: US 6,596,207 B1
(45) Date of Patent: Jul. 22, 2003

(54) PROCESS OF MAKING A FIBER

(75) Inventor: Robert T. Gunn, New York, NY (US)

(73) Assignee: Friction Free Technologies, Inc., New York, NY (US)

( * ) Notice: Subject to any disclaimer, the term of this patent is extended or adjusted under 35 U.S.C. 154(b) by 150 days.

(21) Appl. No.: 09/661,235

(22) Filed: Sep. 13, 2000

Related U.S. Application Data

(62) Division of application No. 09/021,325, filed on Feb. 10, 1998, now Pat. No. 6,143,368.

(51) Int. Cl.[7] ..... D01D 5/32; D01D 5/42
(52) U.S. Cl. ..... 264/45.9; 264/147; 264/172.14
(58) Field of Search ..... 264/45.9, 147, 264/172.14, 173.12

(56) References Cited

U.S. PATENT DOCUMENTS

| | | | | |
|---|---|---|---|---|
| 2,610,539 | A | | 9/1952 | Hedge |
| 2,974,055 | A | | 3/1961 | Scharf |
| 3,147,582 | A | | 9/1964 | Scharf |
| 3,311,486 | A | | 3/1967 | Scharf |
| 3,328,100 | A | | 6/1967 | Spokes et al. |
| 3,590,881 | A | | 7/1971 | Van Amburg |
| 3,749,138 | A | | 7/1973 | Rheaume et al. |
| 3,760,046 | A | * | 9/1973 | Schwartz et al. ..... 264/147 X |
| 3,782,996 | A | | 1/1974 | Belue et al. |
| 3,813,695 | A | | 6/1974 | Podell, Jr. et al. |
| 3,844,826 | A | | 10/1974 | Buchner et al. |
| 3,895,133 | A | | 7/1975 | Fleisig et al. |
| 4,074,512 | A | | 2/1978 | Matt |
| 4,152,784 | A | | 5/1979 | McGalliard |
| 4,153,980 | A | | 5/1979 | Moertel |
| 4,195,362 | A | | 4/1980 | Rolando |
| 4,261,061 | A | | 4/1981 | McAlvage |
| 4,296,499 | A | | 10/1981 | Patterson et al. |
| 4,438,531 | A | | 3/1984 | Long et al. |

(List continued on next page.)

FOREIGN PATENT DOCUMENTS

| | | | |
|---|---|---|---|
| AU | 70407/74 | | 1/1976 |
| AU | 17452/76 | B | 3/1978 |
| AU | 22938/77 | B1 | 9/1978 |
| AU | 77340/94 | B | 1/1992 |
| DE | 20 07 860 | A | 9/1971 |
| DE | 28 20 793 | A | 11/1979 |
| DE | 35 34 401 | A1 | 4/1987 |
| EP | 0 105 773 | A1 | 4/1984 |
| JP | 55 06 22 01 | A | 5/1980 |
| JP | 63051857 | A | 3/1988 |
| JP | 4-327271 | A | 11/1992 |
| JP | 5-263362 | A | 10/1993 |
| JP | 5339879 | A | 12/1993 |
| JP | 6-228866 | A | 8/1994 |
| WO | WO 95/17107 | A1 | 6/1995 |

OTHER PUBLICATIONS

K. Herring and D. Richie, Journal of the American Podiatric Medical Association, "Friction Blisters and Sock Fiber Composition", vol. 80/No. 2, Feb. 1990, pp. 63–71.
K. Herring and D. Richie, Journal of the American Podiatric Medical Association, "Comparison of Cotton and Acrylic Socks Using a Generic Cushion Sole Design for Runners", vol. 83/No. 9, Sep. 1993, pp. 515–522.
"DuPont PTFE 30 fluoropolymer resin" (facsimile), pp. 2–5 (Undated).

*Primary Examiner*—Leo B. Tentoni
(74) *Attorney, Agent, or Firm*—Frommer Lawrence & Haug LLP

(57) ABSTRACT

A fiber having a surface with a relatively low coefficient of friction portion and a relatively high coefficient of friction portion. The fiber maybe produced by slitting a film/sheet which has been coextruded, laminated and/or coated, or by partially coating a base fiber. Fabrics made from such fibers exhibit increased structural integrity.

9 Claims, 2 Drawing Sheets

KEY
t AND T INDICATE THICKNESS OF FIBER, T>t
A,B,C INDICATE DISTINCT COEFFICIENTS OF FRICTION
$A \neq B \neq C$

U.S. PATENT DOCUMENTS

| | | | | |
|---|---|---|---|---|
| 4,494,247 | A | | 1/1985 | Kelly |
| 4,550,446 | A | | 11/1985 | Herman |
| 4,572,174 | A | | 2/1986 | Eilender et al. |
| 4,751,108 | A | | 6/1988 | Larimore et al. |
| 4,805,240 | A | | 2/1989 | Siqveland |
| 4,843,844 | A | | 7/1989 | Hursh et al. |
| 4,864,669 | A | | 9/1989 | Jones |
| 4,881,276 | A | | 11/1989 | Swan |
| 4,922,551 | A | | 5/1990 | Anthes |
| 4,967,494 | A | | 11/1990 | Johnson |
| 5,071,705 | A | * | 12/1991 | Tanaka et al. ..... 264/147 X |
| 5,123,113 | A | | 6/1992 | Smith |
| 5,154,682 | A | | 10/1992 | Kellerman |
| 5,260,360 | A | | 11/1993 | Mrozinski et al. |
| 5,271,211 | A | | 12/1993 | Newman |
| 5,323,815 | A | | 6/1994 | Barbeau et al. |
| 5,376,441 | A | | 12/1994 | Wu et al. |
| 5,385,694 | A | | 1/1995 | Wu et al. |
| 5,500,247 | A | | 3/1996 | Hagqvist |
| 5,575,012 | A | | 11/1996 | Fox et al. |
| 5,590,420 | A | | 1/1997 | Gunn |
| 5,752,278 | A | | 5/1998 | Gunn |
| 5,807,633 | A | | 9/1998 | Tamaru et al. |
| 5,829,057 | A | | 11/1998 | Gunn |
| 5,856,046 | A | | 1/1999 | Heilmann et al. |

* cited by examiner

KEY t AND T INDICATE THICKNESS OF FIBER, T>t

A,B,C INDICATE DISTINCT COEFFICIENTS OF FRICTION $A \neq B \neq C$

PROCESS OF MAKING A FIBER

CROSS REFERENCE TO RELATED APPLICATIONS

This application claims the benefit of priority to U.S. application Ser. No. 09/021,325, filed on Feb. 10, 1998 now U.S. Pat. No. 6,143,368.

FIELD OF THE INVENTION

This invention relates to fibers having low coefficient of friction surfaces and methods for producing such fibers. The fibers may be incorporated into fabrics to produce articles of clothing that reduce the coefficient of friction between the articles of clothing and the body surface of a wearer or the external surface of an object or fluid media.

DESCRIPTION OF THE PRIOR ART

There are many well known processes for manufacturing fibers. Fibers are typically structures whose length is significantly greater than any of their other dimensions usually, their length is at least 100 times as large as their diameter. Fibers may be natural, synthetic, organic or inorganic. Often, the bulk polymers from which synthetic fibers are formed, maybe useful as plastics or films depending upon the type and degree of molecular orientation and the relative dimensions of the finished structure.

Fibers are usually produced by drawing, spinning or stretching a bulk material so that the molecules are predominantly aligned in the drawn, spun, or stretched direction. Subsequent drawing of the fiber below its melt temperature significantly alters the fiber's mechanical properties.

Fibers may also be produced by slitting an oriented film or sheet. If prepared from oriented sheet, the slit sheet will require subsequent drawing to obtain the required fiber properties.

Most synthetic fibers may be produced as long continuous filament or as staple. Staple is produced by cutting continuous filament into short lengths. Most natural fibers are produced as staple, with silk being a notable exception.

Continuous filament and staple are often post treated to alter their surface characteristics. Such surface treatments may include scouring by surface active agents to remove surface impurities, sizing by a surface coating to protect the fiber during weaving, dyeing to modify the color of the fiber and lubrication by refined petroleum products to reduce static and the coefficient of friction.

It is apparent in the prior art that coating a staple or filament will usually provide a fiber having a surface completely covered by the coating. In cases where a low coefficient of friction is desired, this may sometimes be undesirable. For applications in which a low coefficient of friction might be needed on the top and/or bottom surface of a fiber, uniformly coated fibers might not provide the optimum balance of properties after being woven into a fabric which is used to create clothing apparel.

Most apparel is made out of many materials, natural and man-made. They include cotton, wool, silk, linen, leather, vinyl, nylon—polyamides and polyamide co-polymers, LYCRA SPANDEX™ in different filament configurations, orlon polyvinylidene fluoride, such as KYNAR™ and polyester, for example, polyethylene terepthalate, glycol modified polyesters, such as PETG, KODURA™, rayon, orlon cellulosic fiber blends, and the like, as well as blends of the above.

Of course, apparel, either directly or indirectly, contacts the body surface of the wearer. The movement of the wearer causes frictional contact between the wearer's body surface and the apparel. This frictional contact can cause irritation, blisters, and callouses and s particularly a problem in sporting apparel wherein the formation of irritations, blisters, and callouses is exacerbated by the rapid and/or repetitious body movements related to the particular activity. Additionally, it is noted that most apparel has specific areas of high body surface/apparel contact which produces a majority of the irritations, blisters, and callouses.

One way to overcome the problems caused by frictional contact between an article of clothing and the wearer is to make the clothing from low friction fabric. Such fabric may be made from fibers that have a low friction outer surface. However, when the low friction fibers are woven together to produce a fabric the low fiber-to-fiber coefficient of friction is likely to decrease fabric stability by enabling the fibers to easily slide among themselves. This problem is recognized in U.S. Pat. No. 5,035,111 to Hogenboom et al. Hogenboom attempts to overcome the problem by spinning yarns or fibers having a low coefficient of friction with yarns or fibers having a high coefficient of friction. However, Hogenboom does not disclose modifying the fibers themselves. Moreover, Hogenboom's fibers are not made through coextrusion, lamination, and/or coating of a film, sheet or fiber, whereby only a portion of the fiber surface exhibits a low coefficient of friction.

OBJECTS AND SUMMARY OF THE INVENTION

It has been recognized that the prior art has failed to provide a means for producing a fiber having at least one surface with low coefficient of friction characteristics yet retaining the properties desirable for weaving the fiber into a fabric (e.g., structural stability and high tensile strength).

Accordingly, it is an object of the present invention to provide a method of producing fibers having low coefficient of friction surfaces or smooth surfaces for incorporating into fabrics while retaining the properties desirable for weaving the fiber into a fabric.

Specifically, it is an object of the present invention to provide a fiber having low coefficient of friction surfaces that retains the fabric stability after being woven into a fabric.

More specifically, it is an object of the present invention to produce through coextrusion, lamination, and/or coating a fiber having at least one low coefficient of friction surface.

It is still another object of the present invention to provide a durable high tensile-strength fiber having at least one low coefficient of friction surface and being suitable for use in weaving a fabric having at least one low coefficient of friction surface.

An aspect of this invention is to provide fibers prepared from oriented film or sheet. The film/sheet is formed through coextrusion, lamination, and/or coating such that the top and/or bottom surfaces have a different coefficient of friction than the center or internal layer(s) of material. Such fibers may be twisted in preferred sequences and/or orientations such that the center layer(s), having a higher coefficient of friction, interact with other members of the fabric construction to provide increased woven fabric construction stability. This stability is realized by having the higher coefficient of friction surfaces of the coextruded, laminated, and/or coated fiber contact additional surfaces of the gross fabric structure.

Another aspect of this invention is to partially coat a "base fiber" with a low coefficient of friction material such that the coated surface of the base fiber has a lower coefficient of friction than the non-coated surface. Like the fibers prepared from film or sheet, the partially coated fibers may be twisted in preferred sequences and/or orientations such that the non-coated surfaces, having a higher coefficient of friction than the coated surfaces, interact with other members of the fabric construction to provide increased woven fabric construction stability.

Still another aspect of this invention is to provide coextruded, laminated, and/or coated fibers in which the core layer/base fiber has shock absorbing characteristics (e.g., core layer(s) are open or closed celled foams). Such fibers provide increased cushioning values in addition to a low coefficient of friction on their treated surfaces.

Yet another aspect of this invention is to provide fibers in which the core layer/base fiber provides desirable thermal characteristics. For example, the core layer/base fiber may include an insulating material for restricting the escape of heat energy, or a radiant material for facilitating the escape of heat energy.

It is apparent that the fibers of the present invention may be used to create fabrics having enhanced woven fabric stability, shock absorption capacity and/or thermal properties. Thus the present invention provides for a decrease in intra- and extra- fabric coefficient of friction, while at the same time increasing fabric stability and enhancing thermal characteristics.

By using low coefficient of friction materials during either the coextrusion, lamination, and/or coating processes, a novel fiber is produced, with at least a portion of the surface of the novel fiber exhibiting low coefficient of friction, characteristics and the remaining surface portion of the fiber exhibiting relatively higher coefficient of friction characteristics.

The novel fiber can be incorporated into a fabric to produce a fabric having a smooth surface, and the smooth surface fabric can, in turn, be incorporated into clothing to produce clothing having a smooth surface.

Other objects, features and advantages according to the present invention will become apparent from the following detailed description of the illustrated embodiments when read in conjunction with the accompanying drawings.

DETAILED DESCRIPTION

Figure 1:
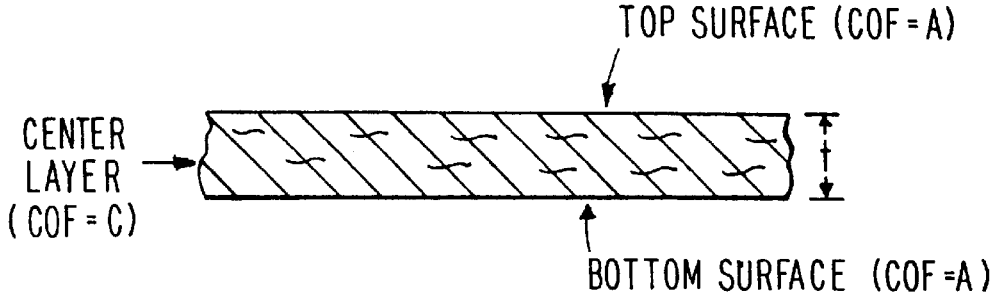
FIG. 1 is a cross sectional view of a fiber having low coefficient of friction surfaces according to the present invention; wherein the coefficient of friction of the top surface is the same as the coefficient of friction of the bottom surface, and both the top and bottom surfaces have a coefficient of friction that is lower than the coefficient of friction of the center layer/side surface.

The fiber of the present invention is preferably produced by slitting oriented film or sheet, and more preferably produced by orienting and slitting extruded film or sheet, the extruded film or sheet being formed via a coextrusion process. Alternatively, a single or multi-layer film or sheet may be laminated to other materials such that its top and/or bottom surfaces are different from the core layer(s). As an additional alternative, a single or multi-layer film may be coated with one or more materials such that its top and/or bottom surfaces are different from the core layer(s). As still another alternative, a "base fiber" may be partially coated with a low coefficient of friction material such that the coated surface of the base fiber has a lower coefficient of friction than the non-coated surface.

In the film/sheet embodiment, low coefficient of friction materials are used to form the top and/or bottom surfaces of the film or sheet, such that the top and/or bottom fiber surfaces exhibit low coefficient of friction characteristics. Accordingly, the fibers that result from slitting the film/sheet have top and/or bottom surfaces that exhibit low coefficient of friction characteristics, and side surfaces that exhibit relatively higher coefficient of friction characteristics.

The low coefficient of friction materials must exhibit surface properties that reduce the coefficient of friction. Preferably, the low coefficient of friction material is selected from the group consisting of silicone, silicone copolymers, silicone elastomers, polytetrafluoroethylene, homopolymers and copolymers thereof, graphite, boron, polypropylene and polyethylene.

The most preferred low coefficient of friction material added during coextrusion/lamination/coating and later incorporated into a fabric that comprises an article of clothing is a polytetrafluoroethylene ("PTFE"), also known by its trademark Teflon®. PTFE or Teflon® is a linear polymer with each polymer chain having a low coefficient of friction. PTFE is a fluorocarbon polymer, which is defined in the Condensed Chemical Dictionary, 8th Edition, as including polytetraflubroethylene, polymers of chlorotrifluoroethylene, fluorinated ethylene-propylene polymers, polyvinylidene fluoride, hexafluoropropylene, etc. Also preferred for the present invention are polymers and copolymers based on chlorotrifluoroethylene, poly (vinyl fluoride) and poly(vinylidene fluoride). Copolymers of ethylene and/or additional low coefficient of friction silicone polymers are also acceptable.

The "exposed surfaces" of a fiber according to the present invention are formed as a result of slitting the oriented film/sheet, or as a result of only partially coating the base fiber. As mentioned above, these exposed surfaces can have a higher coefficient of friction than the "unexposed surfaces", due to the exposure of the core material/base fiber. More specifically, the exposed surfaces have coefficients of friction ranging from 1.10 to 5.00 or more times the coefficient of friction of the unexposed surfaces. The exposed surface coefficient of friction depends upon the exposed area, the chemical make-up of the exposed area and the surface characteristics of the exposed area. Advantageously, the fibers of the invention are less prone to detract from the stability and durability of fabric then are coated filament or stable, because unlike coated filament and stable, the fibers of the invention have exposed surfaces of a relatively high coefficient of friction.

In the film/sheet embodiment, typical exposed surfaces consist of "tie-layers" such as adhesives (Admer {TM}, Bynel {TM}, et al.) adjoining the primary strength layers. Fillers, such as mica, calcium carbonate, talc or other particulates may be added to any of the layers to affect adhesion, barrier and/or ergonomic factors. Combinations of fillers and foaming agents may also be used as the core layers. The core layers may also consist of engineering resins (e.g., Nylon, Polyester) or natural fibers, modified to improve the performance of such layers.

Moreover, the core laer(s)/base fiber may be selected to impart the fiber of the invention with desirable characteristics. In one embodiment, the core layer/base fiber has shock absorbing characteristics (e.g., core layer(s) are open or closed celled foams) to provide increased cushioning values in addition to a low coefficient of friction on the treated surface. In another embodiment, the core layer/base fiber provides desirable thermal characteristics in addition to a low coefficient of friction on the treated surface. For example, the core layer/base fiber may include an insulating material for restricting the escape of heat energy, or a radiant material for facilitating the escape of heat energy.

Additionally in the film/sheet process, by using materials having different coefficients of friction for respective sides of the film/sheet the resulting coefficient of friction of the fiber can be controlled so that the coefficients of friction of the top and bottom surfaces of the fiber differ. In turn, such fibers may be used to form a fabric wherein the coefficient of friction of the top and bottom surface of the fabric differ. For example, any of the previously mentioned low friction materials can be used to create the low friction surface of the fabric, while a high friction material such as rubber, cotton, elastomers, polyacrylates, polymerhacrylates, and polyurethans can be used to create the relatively high friction surface of the fabric. More generally, the relatively high friction materials may include any materials having a coefficient of friction greater than 0.3. In one possible embodiment a bathing suit can be designed to have a low coefficient of friction on the suit surface exposed to water, to increase swimming speed, and a high coefficient of friction on the surface exposed to the wearer, to minimize suit movement on the body. Such a bathing suit could readily be produced using fabrics made up of fibers obtained from the previously described films/sheets.

One embodiment according to the present invention is a multilayered fiber with one surface having a low coefficient of friction characteristic and a second surface having a "hand enhanced" characteristic. Fabrics woven from such multilayered fibers are ideal for use in socks, garments, wound treatments, diving apparel and other garments or devices in which a low coefficient of friction material is undesirable on the inner surface as it would feel uncomfortable on the skin, but is desirable on the outer surface because it would permit more movement or gliding action.

Multilayered fibers could be produced in which the low coefficient of friction surface is opposed by a surface which is porous to allow either the migration of medicines into the skin or the absorption of moisture from the skin. Uniformly low coefficient of friction coated continuous filament or staple would be significantly less desirable in such applications because the uniformly low coefficient of friction filament/staple is more costly.

The fibers of the present invention, which are made from one or more low coefficient of friction materials, are more cost effective than standard low coefficient of friction filaments and staple. This is because only a portion of the invention's fibers contain low coefficient of friction material, while many of the standard low coefficient of friction filaments and staple are completely coated or surrounded with low coefficient of friction materials. Since low coefficient of friction material is a premium product and the fibers of the invention contain less such material than the standard low coefficient of friction filaments and staple, the fibers of the invention are relatively cheaper than the standard low coefficient of friction filaments and staple.

Figure 2:
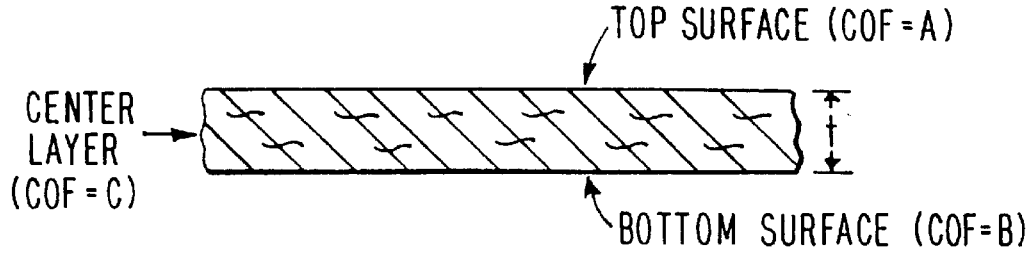
FIG. 2 is a cross sectional view of a fiber having low coefficient of friction surfaces according to the present invention; wherein the coefficient of friction of the top surface is different from the coefficient of friction of the bottom surface, and either one of, or both of, the top and bottom surfaces has a coefficient of friction that is lower than the coefficient of friction of the center layer/side surfaces.
Figure 3:
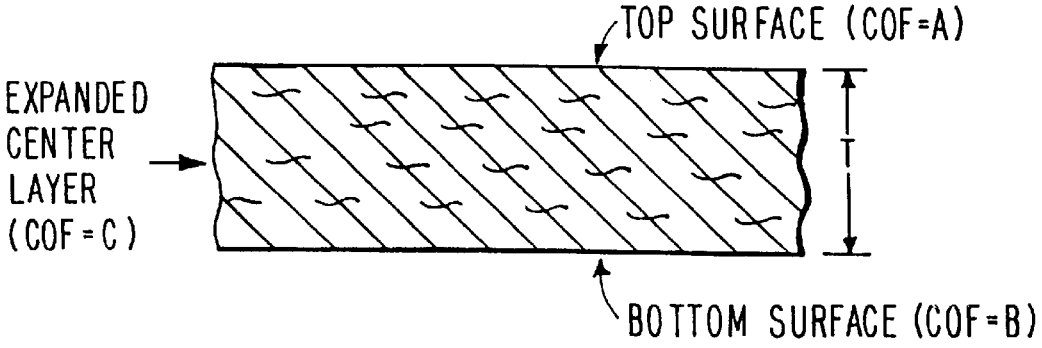
FIG. 3 is a cross sectional view of a fiber having low coefficient of friction surfaces and an expanded center layer according to the present invention; wherein the coefficient of friction of the top surface is different from the coefficient of friction of the bottom surface, and either one of, or both of, the top and bottom surfaces has a coefficient of friction that is lower than the coefficient of friction of the center layer/side surfaces.
Figure 4:
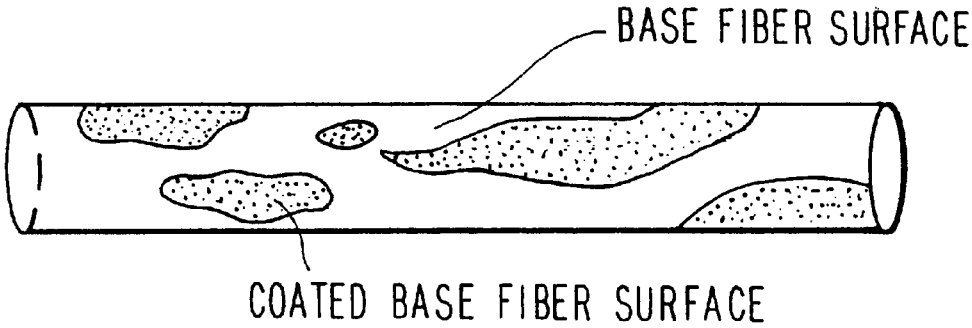
FIG. 4 is an isometric view of a base fiber that is partially coated with a low coefficient of friction material according to the present invention.

Exemplary embodiments of the invention are illustrated in FIGS. 1 to 4.

Although preferred embodiments of the present invention and modifications thereof have been described in detail herein, it is to be understood that this invention is not limited to those precise embodiments and modifications, and that other modifications and variations may be affected by one skilled in the art without departing from the spirit and scope of the invention as defined by the appended claims.

What is claimed is:

1. A method of producing a fiber, comprising the steps of forming a sheet of material through coextrusion, said coextruded sheet having at least a first outer layer, a second outer layer, and a center layer, wherein said center layer is made up of a material having a higher coefficient of friction than the material making up at least one of said outer layers; and orienting and slitting the coextruded sheet to form fibers, such that the top surface of said fibers are made up of the same material as said first outer layer, the bottom surface of said fibers are made up of the same material as said second outer layer, and the side surfaces of said fibers are made up of only the same material as said center layer.

2. The method set forth in claim 1, wherein the material used to form at least one of said first and second outer layers includes a material selected from the group consisting of: silicone, silicone copolymers, silicone elastomers, polytetrafluoroethylene, homopolymers and copolymers thereof, graphite, boron, polypropylene and polyethylene.

3. The method set forth in claim 2, wherein the material used to form at least one of said first and second outer layers includes polytetrafluoroethylene.

4. The method set forth in claim 1, wherein the material used to form at least one of said first and second outer layers includes a material having a coefficient of friction that is less than 0.3.

5. The method set forth in claim 1, wherein the material used to form said first outer layer and the material used to form said second outer layer have different coefficients of friction.

6. The method set forth in claim 1, wherein the material used to form said first outer layer and the material used to form said second outer layer have the same coefficient of friction.

7. The method set forth in claim 1, wherein the material used to form said first outer layer and the material used to form said second outer layer are the same material.

8. The method set forth in claim 1, wherein the material making up said center layer includes a material, or a combination of materials, selected from the group consisting of: a shock absorbing material, a thermally insulating material and a thermal radiating material.

9. The method set forth in claim 1, where the material making up said center layer is foam.

* * * * *